United States Patent [19]

Ohata et al.

[11] Patent Number: 4,583,843

[45] Date of Patent: Apr. 22, 1986

[54] DEVICE FOR DEVELOPING LATENT ELECTROSTATIC IMAGE

[75] Inventors: Yosuke Ohata, Habikino; Keiichiro Hyodo, Kobe, both of Japan

[73] Assignee: Mita Industrial Co., Ltd., Osaka, Japan

[21] Appl. No.: 626,828

[22] Filed: Jul. 2, 1984

[30] Foreign Application Priority Data

Jul. 18, 1983 [JP] Japan ..... 58-129554

[51] Int. Cl.[4] ..... G03G 15/00

[52] U.S. Cl. ..... 355/3 DD; 335/14 D

[58] Field of Search ..... 355/3 DD, 14 D, 3 R, 355/14 R

[56] References Cited

U.S. PATENT DOCUMENTS 4,276,854 7/1981 Fujita et al. ..... 355/3 DD
4,324,483 4/1982 Tagawa et al. .

FOREIGN PATENT DOCUMENTS 0125843 11/1978 Japan ..... 355/3 DD
0167161 12/1981 Japan ..... 355/3 DD

OTHER PUBLICATIONS

Research Disclosure, Mar. 1977 "Magnetic Brush Developing Apparatus" pp. 28–29 James Williams.

*Primary Examiner*—A. T. Grimley

*Assistant Examiner*—David Warren

*Attorney, Agent, or Firm*—Beveridge, DeGrandi & Weilacher

[57] ABSTRACT

A latent electrostatic image developing device comprising a developer receptacle for holding a developer composed of carrier particles and toner particles, a developer applicator means for holding part of the developer in the developer receptacle on its surface and carrying it to a developing zone, a developer agitating means, a toner particle receptacle for holding toner particles and a toner particle feed means for feeding the toner particles from the toner particle receptacle to the developer receptacle. The developer applicator means has a plurality of agitating blades extending in the widthwise direction, and a cut is formed in at least some of the agitating blades. The developing device also has a developer detector for detecting the consentration of the developer, and the developer detector detects the concentration of the excess of the developer removed from the developer applicator means. The developing device also has a partitioning plate for conducting the excess of the developer removed from the developer applicator means to the agitating means. The agitating means moves the developer from one side toward the other side, and the partitioning plate moves the developer removed from the developer applicator means form said other side toward said one side.

11 Claims, 5 Drawing Figures

DEVICE FOR DEVELOPING LATENT ELECTROSTATIC IMAGE

FIELD OF THE INVENTION

This invention relates to a device for developing a latent electrostatic image which is to be applied to an electrostatic copying apparatus and the like.

DESCRIPTION OF THE PRIOR ART

Latent electrostatic image developing devices of the type which employ a two-component developer composed of carrier particles and toner particles have gained widespread commercial acceptance. These developing devices, however, have the following problems.

(A) In order to maintain the ratio between the carrier particles and the toner particles in the developer at a predetermined value by supplying toner particles freshly as the toner particles are consumed, it is important the detect a characteristic of the developer corresponding to the above ratio, for example its inductance, and to control the supply of the toner particles. Owing to the site of detection, etc., however, the characteristic of the developer cannot always be properly detected.

(B) It is desired to mix the developer fully also in the widthwise direction of the developing device and make it sufficiently homogeneous in the widthwise direction, too. This desire cannot be fully met.

In an attempt to solve the aforesaid problems, the present applicants previously proposed an improved latent electrostatic image developing device disclosed in the specification and drawings of Japanese Patent Application No. 63051/1983 (entitled "Electrostatic Copying Apparatus"). This developing device is still not entirely satisfactory, and gives rise to the following problems as will be more specifically described hereinbelow.

(1) Fresh toner particles are supplied to developer agitating means from a toner particle receptacle through a toner particle discharge opening. In particular, when toner particles having good flowability are used, the fresh toner particles become afloat over the developer agitating means by the action of the developer agitating means and cannot be agitated and mixed with the developer.

(2) An excess of the developer is conducted toward the developer agitating means from the surface of a developer applicator means. The developer is guided by a substantially vertical guide surface and a substantially horizontal guide surface. Hence, a part of the developer stagnates in a corner portion defined by the two guide surfaces.

(3) An attempt is made to homogenize the developer in the widthwise direction by swerving an excess of the developer in a predetermined direction from the surface of the developer applicator means by the action of guide projections and thus conducting it to the developer agitating means and simultaneously swerving the developer agitated by the developer agitating means in a direction opposite to the aforesaid predetermined direction by the action of agitating blades. It is difficult however to maintain a proper balance between the amount of the developer swerved by the guide projections and the amount of the developer swerved by the agitating blades, and the developer is likely to deviate on either side.

SUMMARY OF THE INVENTION

A first object of this invention is to provide a latent electrostatic image developing device in which fresh toner particles are surely agitated and mixed with a developer in a developer receptacle.

A second object of this invention is to provide a latent electrostatic image developing device in which a developer conducted from a developer applicator means to a developer agitating means is prevented from stagnation.

A third object of this invention is to provide a latent electrostatic image developing device in which a developer is fully mixed and homogenized also in the widthwise direction of the developing device.

Other objects of this invention will become apparent from the following description.

According to a first aspect of this invention, there is provided a latent electrostatic image developing device comprising a developer receptacle for holding a developer composed of carrier particles and toner particles, a developer applicator means for holding part of the developer in the developer receptacle on its surface in a developer draw-up zone and carrying it to a developing zone, a developer agitating means disposed in relation to a developer peeling zone located downstream of the developing zone and upstream of the developer draw-up zone when viewed in the moving direction of the developer and the upstream end portion of the developer draw-up zone when viewed in the moving direction of the developer, a toner particle receptacle having a toner particle discharge opening and located above the developer agitating means, and a toner particle supplying means adapted to be operated selectively to supply toner particles from the toner particle receptacle to the developer receptacle through said discharge opening; wherein the developer agitating means is constructed of a rotary agitating mechanism having a plurality of agitating blades extending in the widthwise direction at circumferentially spaced intervals, and a cut portion is formed in at least some of the agitating blades.

According to a second aspect of this invention, there is provided a latent electrostatic image developing device comprising a developer receptacle for holding a developer composed of carrier particles and toner particles, a developer applicator means for holding a part of the developer in the developer receptacle on its surface in a developer draw-up zone and carrying it to a developing zone, a brush length-adjusting member for removing the excess of the developer from the surface of the developer applicator means disposed at a predetermined distance from the surface of the developer applicator means in a brush length-adjusting zone located downstream of the developer draw-up zone and upstream of the developing zone when viewed in the moving direction of the developer carried while being held on the surface of the developer applicator means, a developer agitating means disposed in relation to a developer peeling zone located downstream of the developing zone and upstream of the developer draw-up zone when viewed in the moving direction of the developer and the upstream end portion of the developer draw-up zone when viewed in the moving direction of the developer, a toner particle receptacle having a toner particle discharge opening and located above the developer agitating means, a toner particle supplying means adapted to be operated selectively to supply toner particles from the toner particle receptacle to the developer receptacle through said discharge opening, and a contact-type developer detector having a developer contacting surface; wherein the moving path of the developer carried while being held on the surface of the developer applicator means is gradually raised from the upstream end of the developer deaw-up zone to the upstream side of the brush length-adjusting zone when viewed in the moving direction of the developer, a partitioning plate is provided extending above the moving path of the developer from above the developer agitating means to the upstream side of the brush length-adjusting zone, a guide member is attached to the brush length-adjusting member, said guide member extending from the brush length-adjusting member in a direction away from the surface of the developer applicator means and upwardly inclinedly toward the upstream side when viewed in the moving direction of the developer, the developer removed from the surface of the developer applicator means in the brush length-adjusting zone by the action of the brush length-adjusting member is guided by the guide member to the partitioning plate and flows over the partitioning plate and down into the developer agitating means, and the developer contacting surface of the developer detector is exposed to the guiding surface of the guide member.

According to a third aspect of this invention, there is provided a latent electrostatic image developing device comprising a developer receptacle for holding a developer composed of carrier particles and toner particles, a developer applicator means for holding a part of the developer in the developer receptacle on its surface in a developer draw-up zone and carrying it to a developing zone, a developer agitating means for agitating the developer in the developer receptacle, and a partitioning plate for conducting the developer removed from the surface of the developer applicator means to the developer agitating means; wherein the developer agitating means is constructed of a rotary agitating mechanism comprised of a rotating shaft portion, a tubular portion provided concentrically with respect to the rotating shaft portion, a plurality of agitating blades extending in the widthwise direction at circumferentially spaced intervals on the peripheral surface of the tubular portion, and a developer moving blade disposed in the space between the rotating shaft portion and the tubular portion for moving the developer introduced into said space from one side to the other side in the widthwise direction through said space, and a plurality of guide projections are spaced in the widthwise direction on the upper surface of the partitioning plate over which the developer removed from the developer applicator means flows, each of said guide projections being inclined to said one side in the direction of the rotary agitating mechanism so as to move the developer from said other side to said one side.

DETAILED DESCRIPTION OF PREFERRED EMBODIMENTS

The preferred embodiments of the developing device constructed in accordance with this invention will be described below with reference to the accompanying deawings. In the following embodiments, the latent electrostatic image developing device is applied to an electrostatic copying apparatus.

Figure 1:
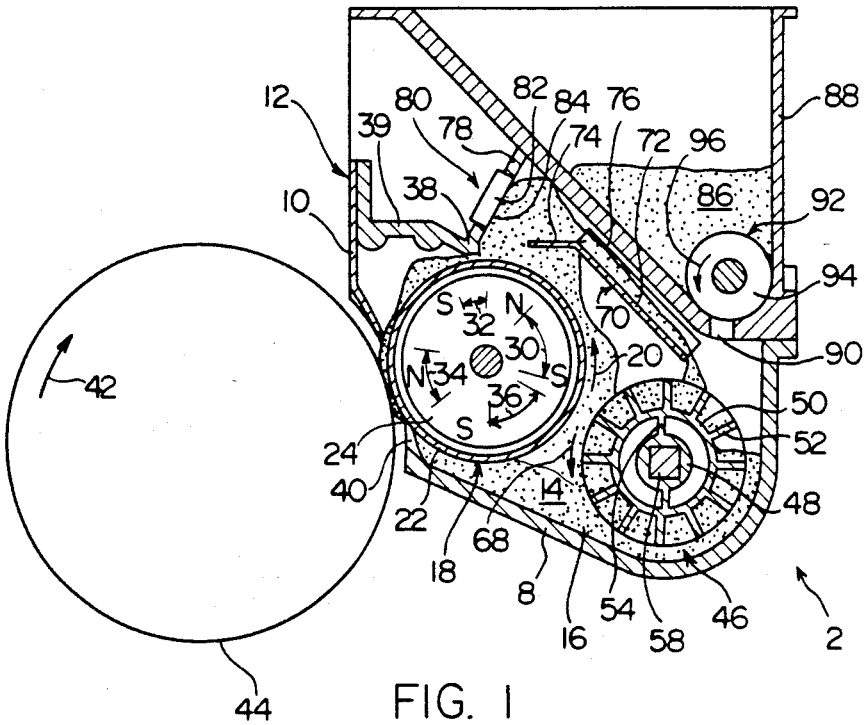
FIG. 1 is a sectional view showing one specific example of the latent electrostatic image developing device constructed in accordance with this invention.

With reference to FIG. 1, the illustrated latent electrostatic image developing device 2 has a development housing 12 defined by a front wall 4 and a rear wall 6 (see FIG. 2) spaced from each other in the front-rear direction (the direction perpendicular to the sheet surface in FIG. 1, and the left-right direction in FIG. 2), a concave bottom wall 8 and a side wall 10. The lower portion of the development housing 12 defines a developer receptacle 16 for holding a two-component developer 14 composed of carrier particles and toner particles.

Figure 2:
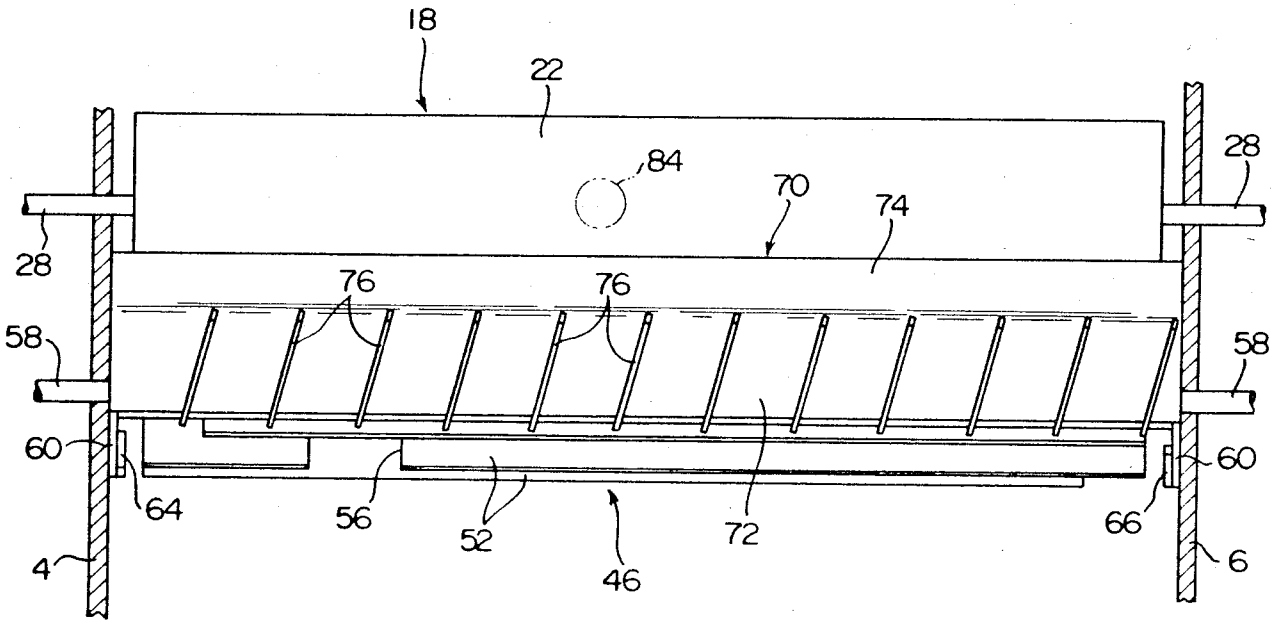
FIG. 2 is a top plan view showing the partitioning plate and its vicinity in the developing device of FIG. 1.
Figure 3:
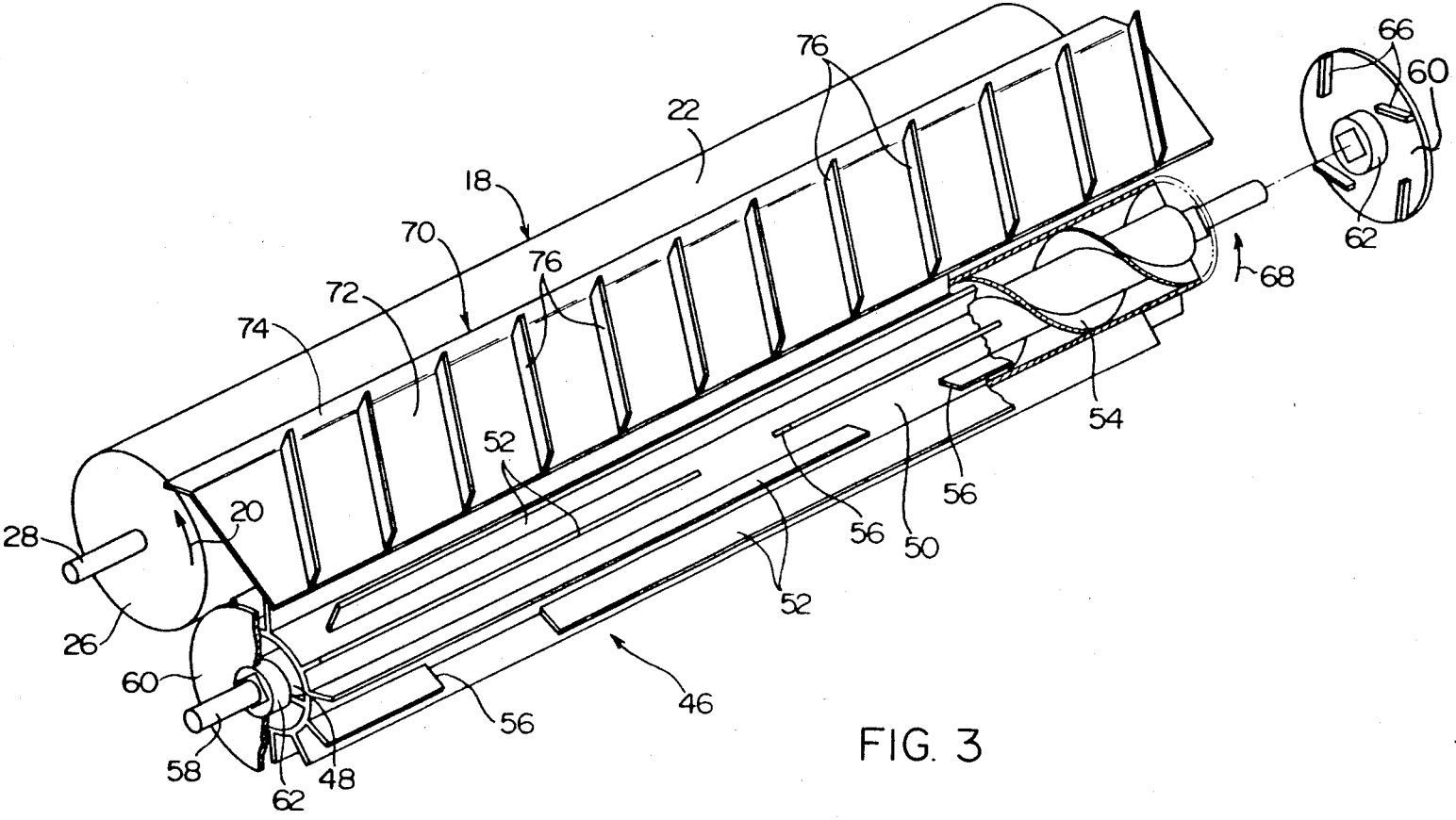
FIG. 3 is a perspective view, partly exploded and partly broken away, of the partitioning plate, developer applicator means and rotary agitating mechanism of the developing device shown in FIG. 1.

A developer applicator means 18 is disposed within the housing 12. The developer applicator means 18 in the illustrated embodiment is comprised of a rotatable cylindrical sleeve member 22 and a stationary permanent magnet 24 disposed within the sleeve member 22. Disc-like end plates 26 (only one of which is shown in FIG. 3) are secured to the opposite ends of the cylindrical sleeve member 22, and a supporting shaft 28 (constituting the axis of rotation extending substantially horizontally in the widthwise direction; see FIGS. 2 and 3) extending in the front-rear direction (i.e., in the widthwise direction of the developing device 2) is fixed to each of the end plates 26. The supporting shaft 28 is rotatably supported across the front wall 4 and the rear wall 6. A linking means (not shown) is mounted on one of the supporting shafts 28 (that supporting shaft which is located rearwardly in the front-rear direction), and drivingly connected to a driving source (not shown) for the electrostatic copying apparatus through a suitable means. Accordingly, the cylindrical sleeve member 22 is rotated by the driving source in a predetermined direction (counterclockwise direction in FIG. 1) shown by an arrow 20 about the supporting shaft 28 (and therefore, the aforesaid axis of rotation). The stationary permanent magnet 24 is roll-like, and has a plurality of circumferentially spaced magnetic poles (i.e., three S poles and two N poles located among them) at its peripheral edge portion.

Around the cylindrical sleeve member 22 of the developer applicator means 18 are located successively in the rotating direction shown by the arrow 20 a developer draw-up zone 30, a brush length-adjusting zone 32, a developing zone 34 and a developer peeling zone 36. The developer draw-up zone 30 is disposed on one side (on the right side in FIG. 1) of the sleeve member 22, and the brush length-adjusting zone 32 is arranged at nearly the highest portion of the sleeve member 22. The developing zone 34 is arranged on the other side (the left side in FIG. 1) of the sleeve member 22. The developer peeling zone 36 is located on said one side of the sleeve member 22 and downwardly of the developer draw-up zone 30.

A brush length-adjusting member 38 is provided in the brush length-adjusting zone 32. In the illustrated embodiment, the brush length-adjusting member 38 is constructed of a suspended projecting portion provided in a member 39 fixed to the inside surface of the side wall 10. The tip of the brush length-adjusting member 38 is placed in proximity to the peripheral surface of the sleeve member 22 with a small space which may, for example, be about 1 mm. In the developing zone 34, the peripheral surface of the sleeve member 22 faces the peripheral surface of a rotating drum 44 mounted on the electrostatic copying apparatus so as to rotate freely in the direction of an arrow 42 with a small distance through an opening 40 defined between the lower end edge of the side wall 10 and one edge of the bottom wall 8. The rotating drum 44 has a photosensitive material on its peripheral surface, and a latent electrostatic image is formed on the photosensitive material by a method known per se.

Figure 4:
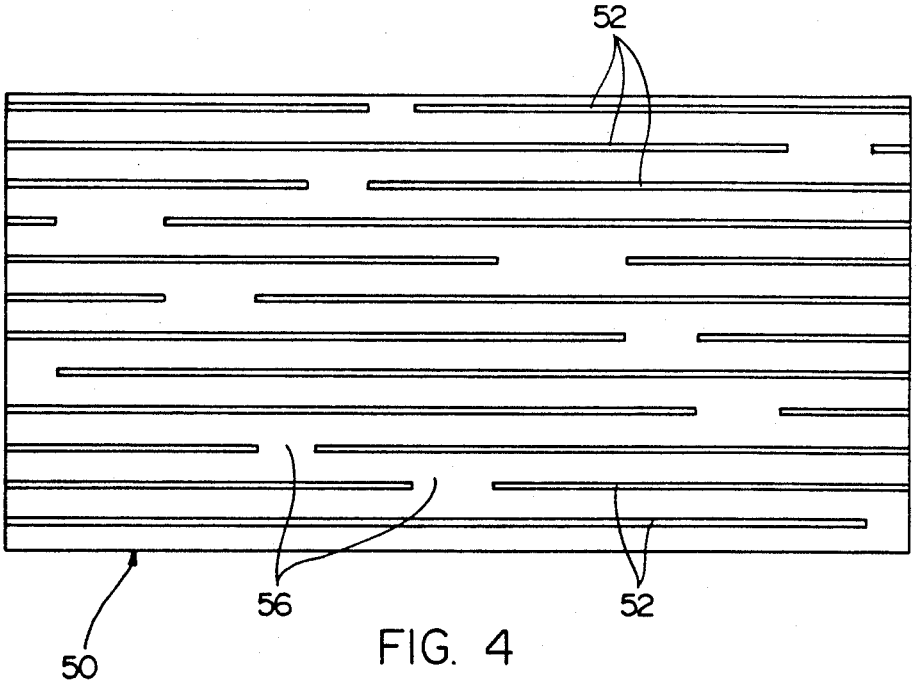
FIG. 4 is a view showing the tubular portion of the rotary agitating mechanism of FIG. 3 in the expanded state.

A developer agitating means constructed of a rotary agitating mechanism 46 is also disposed within the development housing 12. As is clearly seen from FIG. 1, the rotary agitating mechanism 46 is disposed adjacent to one side of the sleeve member 22 and over an area ranging from the developer peeling zone 36 to the upstream end portion of the developer draw-up zone 30 when viewed in the rotating direction of the sleeve member 22 shown by the arrow 20. With reference to FIGS. 1 and 3, the illustrated rotary agitating mechanism 46 is comprised of a rotating shaft portion 48 extending substantially parallel to the aforesaid axis of rotation of the sleeve member 22, a tubular portion 50 provided concentrically with respect to the rotating shaft portion 48, a plurality of agitating blades 52 provided at spaced-apart relationship on the peripheral surface of the tubular portion 50 and extending in its widthwise direction (the direction perpendicular to the sheet surface in FIG. 1, and the direction extending from left bottom to right top in FIG. 3), and a helical blade 54 constituting a developer moving blade and disposed between the rotating shaft portion 48 and the tubular portion 50. The helical blade 54 extends helically from one end side to the other end side of the tubular portion 50 in its widthwise direction. A rectangular cut portion 56 is formed in the agitating blades 52 extending radially in the radially outward direction. Preferably, the cut portions 56 are formed in at least most of the agitating blades 52 with their widthwise positions properly deviated. In the illustrated embodiment, one cut portion 56 is formed in each of the agitating blades 52 as shown in FIG. 4 showing the tubular portion 50 in an enlarged view. The cut portions 56 are arranged with their widthwise positions deviated. One cut portion 56 is always present on the entire periphery of the tubular portion 50, and these cut portions 56 are disposed over the entire width of the tubular portion 50. An axially extending through-hole having a rectangular cross section is formed in the rotating shaft portion 48 of the rotary agitating mechanism 46, and a rectangular shaft member 58 (constituting the axis of rotation of the rotary agitating mechanism 46) is fitted in the through-hole. On both end portion of the shaft member 58, i.e. on both sides of the rotary agitating mechanism 46, are mounted circular end plates 60 (see FIGS. 2 and 3) respectively spaced from the opposite ends of the tubular portion 50 in the widthwise direction so that they rotate as a unit with the shaft member 58. In the illustrated embodiment, the circular end plate 60 having a rectangular hole is passed over each projecting portion of the shaft member 58, and a boss portion 62 formed on its inside surface is contacted with the tubular portion 50. As a result, the circular end plate 60 is mounted while being spaced widthwise from each end of the tubular portion 50. A plurality of guide projections 64 (four in the illustrated embodiment, and FIG. 2 shows one of them) for guiding the developer 14 into a space defined between the rotating shaft portion 48 and the tubular portion 50 are provided on the inner surface of one circular end plate 60 mounted on one end side of the shaft member 58 (the left one in FIG. 2, and the circular end plate 60 disposed at the left bottom in FIG. 3). Furthermore, a plurality of guide projections 66 (four as in FIG. 3) for carrying the developer 14 in the space between the rotating shaft portion 48 and the tubular portion 50 radially outwardly are provided on the inner surface of the other circular end plate 60 mounted on the other end of the shaft member 58 (the circular end plate 60 on the right in FIG. 2 and at right top in FIG. 3). The shaft member 58 having the rotary agitating mechanism 46 and the circular end plates 60 mounted thereon is rotatably supported across the front wall 4 and the rear wall 6 as shown in FIG. 2. A linking means (not shown) is mounted on the other end (hence, the rear end in the front-rear direction) of the shaft member 58, and drivingly connected to the aforesaid driving source (not shown) through a suitable means. Accordingly, the rotary agitating mechanism 46 is rotated by the driving source in a predetermined direction shown by an arrow 68 about the shaft member 58 (the counter-clockwise direction in FIG. 1 which is the same as the rotating direction of the sleeve member 22 shown by the arrow 20).

A partitioning plate 70 is also disposed within the development housing 12. With reference to FIGS. 1 to 3, the illustrated partitioning plate 70 has an inclined portion 72 extending upwardly from its lower end situated above the rotary agitating mechanism 46 while being inclined to the left in FIG. 1, and a horizontal upper end portion 74 extending substantially horizontally from the upper end of the inclined portion 72 to the left in FIG. 1. The horizontal upper end portion 74 is located somewhat upstream of the brush length-adjusting zone 32 in which the brush length-adjusting member 38 exists. As clearly shown in FIGS. 2 and 3, a plurality of (12 in the illustrated embodiment) guide projections 76 are provided at spaced intervals on the upper surface of the inclined portion 72 in its widthwise direction (the front-rear direction perpendicular to the sheet surface in FIG. 1). Each of the guide projections 76 is inclined toward its lower end, namely from the aforesaid other side to the aforesaid one side toward the rotary agitating mechanism 46 (from right to left in FIG. 2, and from right top to left bottom in FIG. 3). As is clear from FIG. 1, the partitioning plate 70 of the above structure extends from above the rotary agitating mechanism 46 to the upstream side of the brush length-adjusting zone 32 and above the moving path of the developer 14 carried from the developer draw-up zone 30 to the upstream side of the brush length-adjusting zone 32.

A guide member 78 extending from the brush length-adjusting member 38 is also provided in the development housing 12. With reference to the embodiment illustrated in FIG. 1, the guide member 78 is constructed of the inclined portion of a member 38 having the brush length-adjusting member 38 formed as a unit. The guide member 78 extends upwardly from the brush length-adjusting member 38, and therefore from the surface of the sleeve member 22, while being inclined toward the aforesaid one side (the right side in FIG. 1), and its under surface defines a guide surface for guiding the developer upwardly toward the aforesaid one side. To the central portion in the widthwise direction of the guide member 78 is fixed a contact-type developer detector 80 of any known type which detects the inductance of the developer 14 corresponding to the ratio between the carrier particles and the toner particles. As can be easily understood from FIG. 1, a circular opening is formed in the guide member 78, and the circular detecting portion 82 of the developer detector 80 is positioned in the circular opening. The lower end surface of the circular detecting portion 82 forms a developer contacting surface 84, and the developer detector 80 detects the inductance of the developer 14 which comes into contact with the developer contacting surface 84. As illustrated in FIG. 1, the developer contacting surface 84 is exposed so that it is on the same plane as the guiding surface of the guide member 78.

In the upper section of the development housing 12 is further disposed a toner particle receptacle 88 for holding toner particles 86. A toner particle discharge opening 90 is formed at the lowermost end portion of the toner particle receptacle 88. The toner particle discharge opening 90 is positioned above a site slightly on the upstream side of the topmost portion of the rotary agitating mechanism 46 as viewed in the rotating direction shown by arrow 68 of the rotary agitating mechanism 46. Toner particle feed means 92 is annexed to the toner particle discharge opening 90. In the illustrated embodiment, the toner particle feed means 92 is constructed of a toner particle feed roller 94 rotatably mounted immediately above the toner particle discharge opening 90. A number of depressions or grooves are formed on the peripheral surface of the toner particle feed roller 94. The toner particle feed roller 94 is adapted to be rotated a predetermined amount in the direction shown by an arrow 96 by a driving source (not shown) such as a stepping motor to be rotated selectively according to the inductance of the developer detected by the detector 80. When the toner particle feed roller 94 is so rotated, the toner particles 86 are carried to the toner particle discharge opening 90 while being held in the depressions or grooves on the peripheral surface of the roller 94. Then, the toner particles pass through the toner particle discharge opening 90 and are let fall toward the rotary agitating mechanism 46 (more specifically, that site of the rotary agitating mechanism 46 which is slightly upstream of its topmost portion as viewed in the rotating direction shown by arrow 68). As a result, the toner particles 86 are fed from the receptacle 88 to the developer receptacle 16.

In the developing device 2 described above, the following actions take place by the rotation of the sleeve member 22 of the developer applicator means 18 in the direction of arrow 20. With reference to FIG. 1, in the developer draw-up zone 30, a part of the developer 14 present in the developer receptacle 16 is attracted to, and held on, the peripheral surface of the sleeve member 22 by the magnetic attracting force of the permanent magnet 24. The developer 14 held on the peripheral surface of the sleeve member 22 is moved in the direction of arrow 20 by the rotation of the sleeve member 22 in the direction of arrow 20, gradually raised from the developer draw-up zone 30, and carried to the brush length-adjusting zone 32. At this time, the developer 14 is moved through the developer moving path positioned below the partitioning plate 70 and along the peripheral surface of the sleeve member 22, as can be easily understood from FIG. 1.

In the brush length-adjusting zone 32, the brush length-adjusting member 38 acts on the developer 14 attracted to, and held on, the peripheral surface of the sleeve member 22 to remove the excess of the developer 14 from the peripheral surface of the sleeve member 22. As a result, the thickness, or the brush length, of the layer of the developer 14 held on the peripheral surface of the sleeve member 22 is adjusted to a predetermined value. The excess of the developer 14 which has been removed from the peripheral surface of the sleeve member 22 by the action of the brush length-adjusting member 38 is carried along the guide surface of the guide member 78 in a direction away from the surface of the sleeve member 22 and inclinedly upwardly toward the upstream side as viewed in the moving direction (the direction of arrow 20) of the developer 14, and conducted to the horizontal upper end portion 74 of the partitioning plate 70. The developer 14 on the horizontal upper end portion 74 then moves over the inclined portion 72 and flows down onto the rotary agitating mechanism 46. On the inclined portion 72, the developer 14 is swerved from the other side to the one side of the partitioning plate 70 (from right to left in FIG. 2) because the guide projections 76 of the inclined portion 72 are inclined from the other side to the one side of the partitioning plate 70. The developer 14 being guided by the guiding surface of the guide member 78 after removal from the peripheral surface of the sleeve member 22 makes contact with the developer contacting surface 84 of the developer detector 80 since the developer contacting surface 84 is exposed to the guiding surface of the guide member 78. Accordingly, the developer detector 80 detects the inductance of this developer 14.

Then, the developer 14 held on the peripheral surface of the sleeve member 22 is carried to the developing zone 34 by the rotation of the sleeve member 22 in the direction of arrow 20, and there comes into contact with the photosensitive material on the rotating drum 44 rotated in the direction of arrow 42. Consequently, the toner particles in the developer 14 are applied to the latent electrostatic image formed on the photosensitive material to develop it into a visible toner image.

The developer 14 held on the peripheral surface of the sleeve member 22 is then carried to the developer peeling zone 36 by the rotation of the sleeve member 22 in the direction of arrow 20. In the developer peeling zone 36, no pole exists in the stationary permanent magnet 24 and therefore its magnetic attracting force is extremely low. In addition, the flow of the developer 14 agitated by the rotary agitating mechanism 46 rotated in the direction of arrow 68 acts on the peripheral surface of the sleeve member 22. Consequently, the developer 14 is peeled off from the peripheral surface of the sleeve member 22.

The rotary agitating mechanism 46 rotated in the direction of arrow 68 agitates the developer 14 peeled from the sleeve member 22 in the developer peeling zone 36, the developer 14 falling onto the rotary agitating mechanism 46 after moving on the partitioning plate 70 in the manner described, and the toner particles 86 which flow onto the rotary agitating mechanism 46 from the toner particle discharge opening 90 of the toner particle receptacle 88 by the action of the toner particle feed roller 94 selectively rotated. Thus, the carrier particles and toner parrticles in the developer 14 are uniformly mixed and the toner particles are triboelectrically charged to a specific polarity. Thereafter, the developer 14 is fed to the developer draw-up zone 30. During the rotation of the rotary agitating mechanism 46, the developer 14 moved by the action of the guide projections 76 of the partitioning plate 70 to one end of the tubular portion 50 of the rotary agitating mechanism 46 from one end side toward the other end side of the partitioning plate 70 passes between one end of the tubular portion 50 and one circular end plate 60 (the circular end plate 60 disposed on the left side in FIG. 2, and at the left bottom in FIG. 3), is guided by the guide projections 64 formed in the circular end plate 60, and introduced into the space between the rotating shaft portion 48 and the tubular portion 50. The developer 14 in the space is moved from one end side to the other end side (from left to right in FIG. 2, and from left bottom to right top in FIG. 3) within the space by the action of the helical blade 54 of the rotary agitating mechanism 46 rotated in the direction of arrow 68. When the developer 14 has been moved to the other end of the tubular portion 50, it is guided by the guide projections 66 formed in the other circular end plate 60 (disposed on the right side in FIG. 2, and at the right top in FIG. 3), and taken out from the aforesaid space by passing between the other end of the tubular portion 50 and the circular end plate 60. Accordingly, the developer 14 which has been swerved toward the one side by the guide projections 76 of the partitioning plate 70 is moved to the other end side through the space between the rotating shaft portion 48 and the tubular portion 50 of the rotary agitating mechanism 46, and consequently, the developer 14 in the developer receptacle 16 is homogenized in the widthwise direction.

The toner particles 86 which have fallen through the toner particle discharge opening 90 by the rotation of the toner particle feed roller 94 are fed to the developer 14 agitated by the agitating blades 52 after going through cuts 56 formed in the agitating blades 52. Thus, fresh toner particles 86 are accurately fed to, and mixed with, the developer 14. As shown in FIG. 4, the cuts 56 are disposed along the entire width of the tubular portion 50 in the properly deviated state so that one cut 56 always exists on the entire periphery of the tubular portion 50. Accordingly, the toner particles 86 are fed substantially uniformly along the entire width of the rotary agitating mechanism 46.

The following points should be noted in the developing device 2 described above.

Firstly, in the latent electrostatic developing device previously proposed by the present Applicant, the toner particles are let fall onto the rotary agitating mechanism from the toner particle receptacle through the toner particle discharge opening. The falling toner particles are directed slightly toward the upstream side of the uppermost site of the rotary agitating mechanism as viewed in the rotating direction of the agitating mechanism. When the flowability of the toner particles is good, the rotation of the rotary agitating means causes the toner particles to be afloat (afloat over the agitating mechanism), and the toner cannot be mixed with the developer or a considerable period of time is required for effecting the mixing. In this case, the toner particles are not agitated and mixed in spite of the consumption of the toner particles in the developer. Hence, the ratio between the toner particles and the carrier particles varies during development, and a good developing action by the toner particles cannot be performed. In contrast, in the developing device 2 improved in accordance with the present invention, the cuts 56 are formed on the agitating blades 52 of the agitating mechanism 46. Hence, the toner particles 86 fall through the cuts 56 even during the rotation of the agitating mechanism 46, and are mixed with the developer 14. Consequently, the ratio between the toner particles and the carrier particles in the developer 14 held by the developer receptacle 16 is maintained substantially constant.

Secondly, in the latent electrostatic image developing device previously proposed by the present Applicant, the excess of the developer removed from the surface of the sleeve member by the action of the brush length-adjusting member is conducted to the rotary agitating mechanism via the partitioning plate. The excess of the developer is conducted to the partitioning member while it is guided by the substantially perpendicular guide surface and the substantially horizontal guide surface. Hence, a part of the developer may undersirably stagnate in a corner portion defined by the substantially perpendicular guide surface and substantially horizontal the guide surface. In contrast, in the developing device 2 improved in accordance with this invention, no developer stagnating portion exists because it includes the guide member 78 which extends from the brush length-adjusting member 38 in a direction away from the sleeve member 22 and upwardly while being inclined on the upstream side as viewed in the moving direction of the developer. As a result, the developer 14 removed from the sleeve member 22 can be moved smoothly toward the partitioning plate 70 along the guide surface of the guide member 78, and the stagnation of the developer can be prevented. Furthermore, since in the improved developing device 2, the developer contacting surface 84 of the developer detector 80 is exposed to the guiding surface of the guide member 78, the developer 14 which has just been agitated and mixed and is flowing well without stagnation and which has substantially the same toner-to-carrier ratio of the developer to be conveyed from the brush length-adjusting zone 32 to the developing zone 34 comes into contact with the developer contacting surface 84 of the developer detector 80. Consequently, the developer detector 80 can properly detect a specific character, such as the inductance, of the developer 14.

Thirdly, in the latent electrostatic image developing device previously proposed by the present Applicant, the developer removed by the action of the brush length-adjusting member is conducted to the rotary agitating mechanism via the partitioning plate and mixed with the developer in the developer receptacle. The mixed developer is then carried to the developer draw-up zone. An attempt is made to homogenize in the widthwise direction the developer to be carried to the developer draw-up zone by swerving the developer removed from the sleeve member in a predetermined direction by the action of the guide projections provided in the partitioning plate and swerving this developer and the developer in the developer receptacle in a direction opposite to the aforesaid predetermined direction by the action of the agitating blades of the rotary agitating mechanism. It is difficult therefore to homogenize in the widthwise direction the developer carried to the developer draw-up zone while keeping a proper balance between the amount of movement of the developer swerved by the guide projections of the partitioning plate and the amount of movement of the developer swerved by the agitating blades. If the balance of the developer by the aforesaid swerving is not maintained, the developer will be forcibly swerved toward one side by the action of the guide projections of the partitioning plate (or the agitating blades) and will be unable to be supplied substantially uniformly over the entire width of the sleeve member. In contrast, in the developing device improved in accordance with this invention, the partitioning plate 70 for conducting the developer 14 removed by the action of the brush length-adjusting member 38 to the rotary agitating mechanism 46 has provided therein the guide projections 76 for moving the developer from the other side to the one side of the partitioning plate 70, and the helical blade 54 for moving the developer 14 from the one side to the other side are disposed in the space between the rotating shaft portion 48 and the tubular portion 50 of the rotary agitating mechanism 46. Accordingly, the developer 14 removed by the action of the brush length-adjusting member 38 is swerved from the other end side to the one end side, and the developer 14 moved to one end of the tubular portion 50 by the above swerving action is moved from the one end side to the other end side via the space between the rotating shaft portion 48 and the tubular portion 50 by the action of the helical blades 54. Consequently, the developer can be maintained substantially uniform in the widthwise direction without presetting the balance between the amount of the developer 14 swerved by the guide projections 76 of the partitioning plate 70 and the amount of the developer 14 swerved by the helical blade 54.

While the developing device of the present invention has been described hereinabove with reference to its preferred embodiments shown in the accompanying drawings, it is to be understood that the invention is not limited to these specific embodiments, and various changes and modifications are possible without departing from the scope of the invention.

What is claimed is:

1. A laten electrostatic image developing device comprising a developer receptacle for holding a developer composed of carrier particles and toner particles;

a developer applicator means for holding part of the developer in the developer receptacle on its surface in a developer draw-up zone and carrying it to a developing zone;

a developer agitating means disposed in relation to a developer peeling zone located downstream of the developer zone and upstream of the developer draw-up zone when viewed in the moving direction of the developer and the upstream end portion of the developer draw-up zone when viewed in the moving direction of the developer;

a toner particle receptacle having a toner particle discharge opening and located above the developer agitating means;

a toner particle supplying means adapted to be operated selectively to supply toner particles from the toner particle receptacle to the developer receptacle through said discharge opening;

wherein the developer agitating means is constructed of a rotary agitating mechanism having a plurality of agitating blades extending in the widthwise direction at circumferentially spaced intervals, and a cut portion is formed in at least some of the agitating blades;

wherein the developer applicator means is comprised of a cylindrical sleeve member adapted to be rotated in a predetermined direction about the axis of rotation extending substantially horizontally in the widthwise direction and a magnet disposed in the sleeve member, the developer draw-zone is located on one side of the sleeve member, the developing zone is located on the other side of the sleeve member, the developer peeling zone is located on said one side of the sleeve member and beneath the developer draw-up zone, and the rotary agitating mechanism is disposed adjacent to said one side of the sleeve member with its axis of rotation being substantially parallel to the axis of rotation of the sleeve member, and adapted to be rotated in the same direction as the sleeve member;

a brush length-adjusting member for removing excess of developer from the surface of the developer applicator means, said brush length-adjusting member being disposed at a predetermined distance from the surface of the developer applicator means in a brush length-adjusting zone provided nearly at the uppermost site of the sleeve member;

a partitioning plate extending from above the rotary agitating mechanism to the upstream side of the brush length-adjusting zone and above the moving path of the developer carried from the developer draw-up zone to the upstream side of the brush length-adjusting zone while being held on the surface of the sleeve member;

a contact-type developer detector having a developer contacting surface;

wherein a guide member extending upwardly from the surface of the sleeve member while being inclined toward one side is attached to the brush length-adjusting member so that developer removed from the surface of the sleeve member by the action of the brush length-adjusting member in the brush length-adjusting zone is conducted to the partitioning plate along the guide member and flows over the partitioning plate and falls onto the rotary agitating mechanism; and wherein the developer contacting surface of the developer detector is exposed to the guiding surface of the guide member.

2. The developing device of claim 1 wherein the toner particles fed from the toner particle receptacle to the developer receptacle via the toner particle discharge opening are let fall toward a site slightly upstream of the uppermost site of the rotary agitating mechanism as viewed in the rotating direction of the rotary agitating mechanism.

3. The developing device of claim 1 wherein the cut portion is provided in at least most of the agitating blades of the rotary agitating mechanism, and the widthwise positions of the individual cut portions are properly deviated.

4. The developing device of claim 3 wherein one said cut portion is formed in all of the agitating blades of the rotary agitating mechanism.

5. The developing device of claim 1 in which the developer agitating means is constructed of a rotary agitating mechanism having a rotating shaft portion, a tubular member provided concentrically with respect to the rotating shaft portion, a plurality of circumferentially spaced agitating blades extending in the widthside direction on the peripheral surface of the tubular portion, and a developer moving blade disposed in the space between the rotating shaft portion and the tubular portion for moving the developer introduced into the space from one end side in the widthwise direction to the other side in the widthwise direction, and a plurality of widthwise spaced guide projections are provided on the upper surface of the partitioning plate over which the developer removed from the developer applicator means flows, each of the guide projections being inclined toward said one end side in the direction of the rotary agitating mechanism so as to move the developer from said other side to said one side.

6. The developing device of claim 5 wherein the developer moving blade is a helical blade helically extending from said one end side toward said other end side.

7. The developing device of claim 5 wherein circular end plates spaced in the widthwise direction respectively from the opposite ends of the tubular portion are provided respectively at the opposite end portions of the rotating shaft portion; a plurality of guide projections for introducing the developer into said space between the rotating shaft portion and the tubular portion are formed on the inner surface of the circular end plate provided on said one end side and a plurality of guide projections for taking out the developer radially outwardly from said space between the rotating shaft portion and the tubular portion are formed on the inner surface of the circular end plate provided on said other end side.

8. A latent electrostatic image developing device comprising a developer receptacle for holding a developer composed of carrier particles and toner particles, a developer applicator means for holding part of the developer in the developer receptacle on its surface in a developer draw-up zone and carrying it to a developing zone, a brush length-adjusting member for removing the excess of the developer from the surface of the developer applicator means disposed at a predetermined distance from the surface of the developer applicator means in a brush length-adjusting zone located downstream of the developer draw-up zone and upstream of the developing zone when viewed in the moving direction of the developer carried while being held on the surface of the developer applicator means, a developer agitating means disposed in relation to a developer peeling zone located downstream of the developing zone and upstream of the developer draw-up zone when viewed in the moving direction of the developer and the upstream end portion of the developer draw-up zone when viewed in the moving direction of the developer, a toner particle receptacle having a toner particle discharge opening and located above the developer agitating means, a toner particle supplying means adapted to be operated selectively to supply toner particles from the toner particle receptacle to the developer receptacle through said discharge opening, and a contact-type developer detector having a developer contacting surface; wherein the moving path of the developer carried while being held on the surface of the developer applicator means is gradually raised from the upstream end of the developer draw-up zone to the upstream side of the brush length-adjusting zone when viewed in the moving direction of the developer, a partitioning plate is provided extending above the moving path of the developer from a site above the developer agitating means to the upstream side of the brush length-adjusting zone, a guide member is attached to the brush length-adjusting member, said guide member extending from the brush length-adjusting member in a direction away from the surface of the developer applicator means and upwardly inclinedly toward the upstream side when viewed in the moving direction of the developer, the developer removed from the surface of the developer applicator means in the brush length-adjusting zone by the action of the brush length-adjusting member is guided by the guide member to the partitioning plate and flows over the partitioning plate and down into the developer agitating means, and the developer contacting surface of the developer detector is exposed to the guiding surface of the guide member.

9. The developing device of claim 8 wherein the developer applicator means is comprised of a cylindrical sleeve member adapted to be rotated in a predetermined direction about the axis of rotation extending substantially horizontally in the widthwise direction, and a magnet disposed in the sleeve member, and the developer draw-up zone is located on one side of the sleeve member, the brush length-adjusting zone is located at the nearly uppermost site of the sleeve member, the developing zone is located on the other side of the sleeve member, and the developer peeling zone is located on said one side of the sleeve member and below the developer draw-up zone.

10. A latent electrostatic image developing device comprising a developer receptacle for holding a developer composed of carrier particles and toner particles;

a developer applicator means for holding part of the developer in the developer receptacle on its surface in developer draw-up zone and carrying it to a developing zone;

a developer agitating means for agitating the developer in the developer receptacle;

a partitioning plate for conducting the developer removed from the surface of the developer applicator means to the developer agitating means;

wherein the developer agitating means is constructed of a rotary agitating mechanism comprised of a rotating shaft portion, a tubular portion provided concentrically with respect to the rotating shaft portion, a plurality of circumferentially spaced agitating blades extending in the widthwise direction on the peripheral surface of the tubular portion, and a developer moving blade disposed in the space between the rotating shaft portion and the tubular portion for moving the developer introduced into the space from one end side in the widthwise direction to the other end side in the widthwise direction through said space;

wherein a plurality of guide projections are spaced in the widthwise direction on the upper surface of the partitioning plate over which the developer removed from the developer applicator means flows, each of said guide projections being inclined toward said one side in the direction of the rotary agitating mechanism so as to move the developer from said other side to said one side;

wherein circular end plates spaced in the widthwise direction respectively from the opposite ends of the tubular portion are provided respectively at the opposite end portions of the rotating shaft portion;

wherein a plurality of guide projections for introducing the developer into said space between the rotating shaft portion and the tubular portion are formed on the inner surface of the circular end plate provided on said one end side;

and wherein a plurality of guide projections for taking out the developer radially outwardly from said space between the rotating shaft portion and the tubular portion are formed on the inner surface of the circular end plate provided on said other end side.

11. The developing device of claim 10 wherein the developer moving blade is a helical blade extending helically from said one end side to said other end side.

* * * * *